US010566120B2

(12) United States Patent
Armstrong et al.

(10) Patent No.: US 10,566,120 B2
(45) Date of Patent: Feb. 18, 2020

(54) FAULT TOLERANT SUPERCONDUCTING MAGNETIC ENERGY STORAGE (SMES) DEVICE

(71) Applicants: Rolls-Royce North American Technologies, Inc., Indianapolis, IN (US); Rolls-Royce Corporation, Indianapolis, IN (US)

(72) Inventors: Michael James Armstrong, Avon, IN (US); Andrew Mark Bollman, Plainfield, IN (US)

(73) Assignees: Rolls-Royce North American Technologies, Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 836 days.

(21) Appl. No.: 15/174,002

(22) Filed: Jun. 6, 2016

(65) Prior Publication Data

US 2017/0358386 A1 Dec. 14, 2017

Related U.S. Application Data

(60) Provisional application No. 62/172,638, filed on Jun. 8, 2015.

(51) Int. Cl.
*H01F 6/06* (2006.01)
*H01F 6/00* (2006.01)

(52) U.S. Cl.
CPC ..... *H01F 6/06* (2013.01); *H01F 6/006* (2013.01); *H01F 6/008* (2013.01)

(58) Field of Classification Search
CPC ..... H01F 6/06; H01F 6/006; H01F 6/008
See application file for complete search history.

(56) References Cited

U.S. PATENT DOCUMENTS

| | | | | |
|---|---|---|---|---|
| 4,336,561 | A * | 6/1982 | Murphy | H01F 36/00 335/216 |
| 4,939,444 | A | 7/1990 | Cacheux | |
| 5,011,820 | A | 4/1991 | Ehrhart et al. | |
| 5,374,914 | A | 12/1994 | Prueitt | |
| 5,473,301 | A | 12/1995 | Hall et al. | |
| 5,525,949 | A | 6/1996 | Hanley et al. | |
| 5,682,304 | A | 10/1997 | Shteynberg | |
| 6,897,749 | B2 | 5/2005 | Jonsson et al. | |
| 7,019,608 | B2 * | 3/2006 | Darmann | H01F 6/06 335/216 |
| 8,456,269 | B2 | 6/2013 | Sohn et al. | |
| 2005/0218257 | A1 * | 10/2005 | Sweeney | H01F 41/08 242/434 |

OTHER PUBLICATIONS

Hawley, et al., "Design and Preliminary Results of a Prototype HTS SMES Device," IEEE Transactions on Applied Superconductivity, vol. 15, No. 2, Jun. 2005, 6 pp.

(Continued)

*Primary Examiner* — Paul A Wartalowicz
(74) *Attorney, Agent, or Firm* — Shumaker & Sieffert, P.A.

(57) ABSTRACT

A superconducting magnetic energy storage (SMES) device having a plurality of interwoven windings provides for alternative discharge paths for energy stored as magnetic fields in the windings in response to an open-circuit winding fault in one of the windings.

20 Claims, 5 Drawing Sheets

(56) References Cited

OTHER PUBLICATIONS

Molina, et al., "Improved Superconducting Magnetic Energy Storage (SEMS) Controller for High-Power Utility Applications," IEEE Transactions on Energy Conversion, 2011, 13 pp. (Applicant points out, in accordance with MPEP 609.04(a), that the year of publication, 2011, is sufficiently earlier than the effective U.S. filing date Jun. 8, 2015, so that the particular month of publication is not in issue.).

* cited by examiner

FAULT TOLERANT SUPERCONDUCTING MAGNETIC ENERGY STORAGE (SMES) DEVICE

This application claims the benefit of U.S. Provisional Application No. 62/172,638 filed Jun. 8, 2015, which is incorporated herein by reference in its entirety.

TECHNICAL FIELD

The present disclosure relates to energy storage devices, and more particularly, to superconducting magnetic energy storage (SMES) devices.

BACKGROUND

Superconducting magnetic energy storage (WES) devices store energy in a magnetic field. The SMES includes a coil or superconducting material that is cooled below the superconducting transition temperature which functions in a superconducting state at such a temperature. The magnetic field is created by the flow of direct current in the superconducting coil.

SUMMARY

In some examples, the disclosure describes a superconducting magnetic energy storage (SMES) device comprising a toroidal former, a first winding comprising a first wire conductor wound around the former, the first winding configured to be in a superconducting state to store energy in a magnetic field, and a second winding comprising a second wire conductor wound around the same former and interwoven with the first winding, the second winding configured to be in the superconducting state and, in response to an open-circuit winding fault in an electrical path of the first winding, configured to dissipate at least a portion of the energy that would have dissipated through the first winding and a portion of the energy that is to be dissipated through the second winding.

In some examples, the disclosure describes an energy delivery system comprising a superconducting magnetic energy storage (SMES) device, the SMES device comprising a toroidal former, a first winding comprising a first wire conductor wound around the former, the first winding configured to be in a superconducting state to store energy in a magnetic field, and a second winding comprising a second wire conductor wound around the same former and interwoven with the first winding, the second winding configured to be in the superconducting state. The system includes a first electrical path through the first winding, the first electrical path comprising a first switch, wherein the first winding is configured to create a first portion of the magnetic field in response to the first switch being closed, a second electrical path through the first winding, the second electrical path comprising a second switch, wherein the first winding is configured to store the energy in the magnetic field in response to the second switch being closed, a third electrical path through the second winding, the third electrical path comprising a third switch, wherein the second winding is configured to create a second portion of the magnetic field in response to the third switch being closed, a fourth electrical path through the second winding, the fourth electrical path comprising a fourth switch, wherein the second winding is configured to store the energy in the magnetic field in response to the fourth switch being closed, and a fifth electrical path through the second winding, wherein, in response to an open-circuit winding fault in the electrical path of the first winding, the fifth electrical path is configured to dissipate at least a portion of the energy that would have dissipated through the first winding and a portion of the energy that is to be dissipated through the second winding.

In some examples, the disclosure describes a method of energy delivery, the method comprising storing energy in a magnetic field in a superconducting magnetic energy storage (SMES) device configured in a superconducting state, the magnetic field being partially generated from a first current flowing through a first winding of a first wire conductor wound around a toroidal former of the SMES device, storing energy in the magnetic field in the SMES device configured in the superconducting state, the magnetic field being partially generated from a second current flowing through a second winding of a second wire conductor wound around the same former of the SMES device and interwoven with first wire of the first winding, and in response to an open-circuit winding fault in an electrical path of the first winding, dissipating at least a portion of the energy that would have dissipated through the first winding and a portion of the energy that is to be dissipated through the second winding.

The details of one or more examples of this disclosure are set forth in the accompanying drawings and the description below. Other features, objects, and advantages of this disclosure will be apparent from the description and drawings, and from the claims.

DETAILED DESCRIPTION

Figure 1:
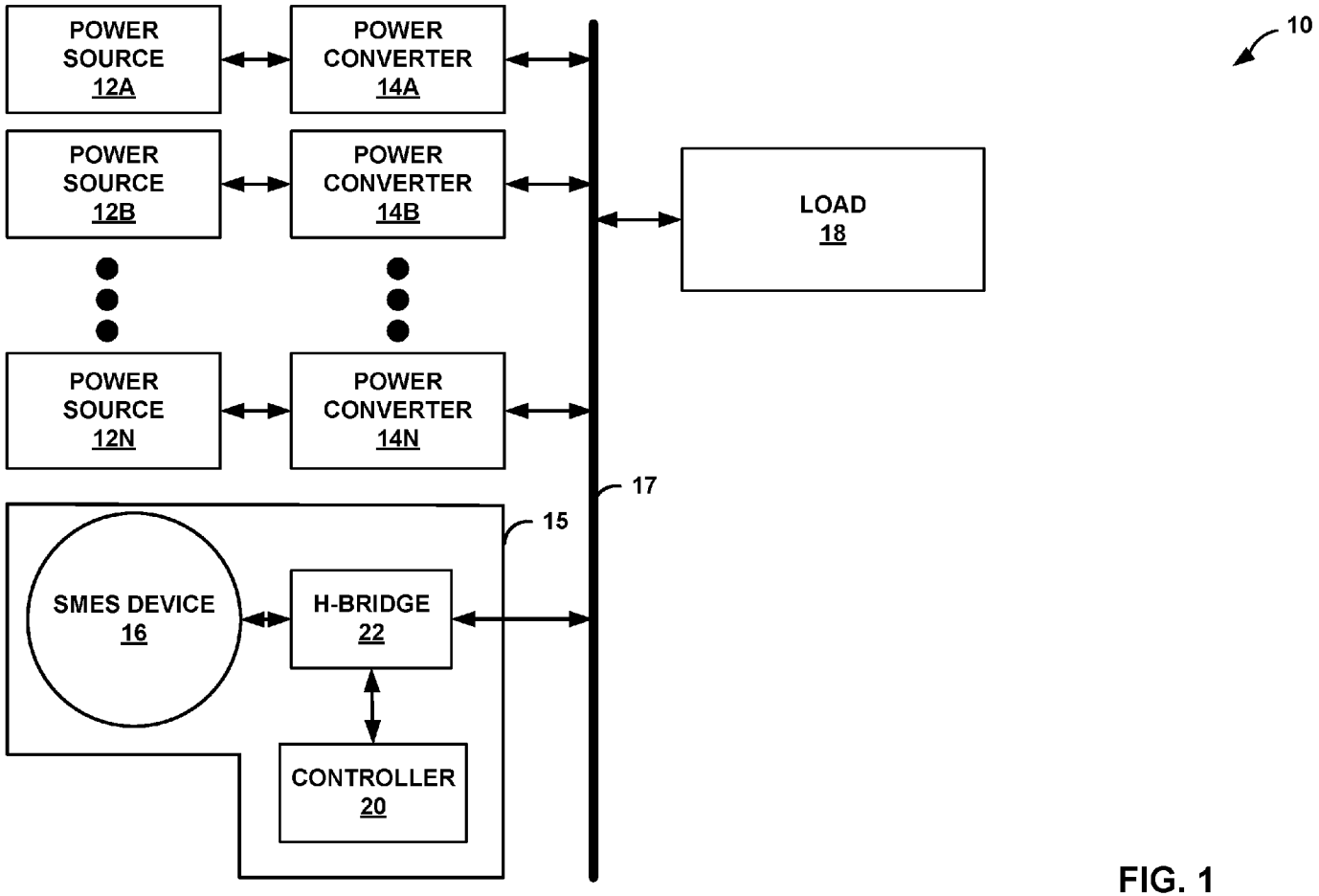
FIG. 1 is a block diagram illustrating an example energy delivery system.

Superconducting magnetic energy storage (SMES) devices store energy in a magnetic field. SMES devices include a superconducting wire or tape wound around a toroidal former (e.g., magnetic core, vacuum core, or another material) to form a coil, and at cryogenic temperatures the coil functions in a superconducting state. For example, the superconducting coil is cryogenically cooled bringing it into the superconducting state, such that the resistivity of the wire approaches zero (i.e., the coil has virtually no electrical resistance) and does not lose energy in the form of heat.

The SEMS device operates in three modes set by the operation of power electronics equipment (e.g., a controller as described in more detail below). The SMES device stores energy in a magnetic field in a charge mode and a maintain mode, and dissipates the energy in a discharge mode. In a charge mode, current flows from a positive node to a negative node (or ground) via the winding of the SMES device. In a maintain mode, the current is diverted to circulate through the winding of the SMES device. In a discharge mode, the current is outputted to deliver power.

The flow of current through the winding during the charge mode creates a magnetic field. In the superconducting state, there is little loss in the current flowing through the winding meaning that the magnetic field is preserved in the maintain mode with a circulating current. In this manner, the SMES device stores energy in a form of a magnetic field. Then, in the discharge mode, current flows out of the SMES device with an associated reduction in the magnetic field.

As a result, SMES devices allow virtually lossless energy storage in the superconducting state, while allowing for extremely fast charge and discharge capability and operation at cryogenic temperatures. Additionally, SMES devices may be utilized to store high amounts of energy and allow for rapid delivery of such energy. However, undesired rapid discharge of energy may need to be avoided through the design of SMES devices which are fault tolerant.

The techniques described in this disclosure describe examples of SMES devices that may be fault tolerant for open-circuit winding faults. As described in more detail, in an open-circuit winding fault, energy stored in the magnetic field attempts to dissipate via an electrical wired dissipation path and, if no alternative path is present, the dissipation occurs via arcing causing various potential issues such as superconducting overcurrent quench events. This disclosure describes example techniques to allow the energy stored in the magnetic field to dissipate through an alternative electrical path in a controlled way to minimize issues related to open-circuit winding faults (e.g., so that the SMES device is open-circuit winding fault tolerant).

In examples described in this disclosure, rather than forming the magnetic field utilizing a single wire wound around a former (e.g., core) of the SMES device (e.g., magnetic core, but not necessarily a magnetic core), a plurality of wires are wound around the same former. The windings are interwoven (e.g., interspersed or layered) with one another. For example, the windings are not in distinct separate locations on the core. The individual windings together create a magnetic field, and in the discharge mode, the current in each winding outputs to collapse the magnetic field. However, in the event of a fault (e.g., open-circuit winding fault) on one of the windings, the energy of the magnetic field can flow through the remaining "healthy" windings in a controlled way. Accordingly, rather than a fast, uncontrolled discharge of the energy stored in a magnetic field created by current through a winding, in the event of a fault in that winding, the energy stored in the magnetic field can discharge through the other windings.

In this way, the disclosure describes an SMES device that includes a former (e.g., a toroidal core) and at least a first winding and a second winding. The first winding includes a first wire conductor wound around the former and is configured to be in a superconducting state to store energy in a magnetic field. The second winding includes a second wire conductor wound around the same former and interwoven with the first winding. The second winding is also configured to be in the superconducting state and, in response to an open-circuit winding fault in an electrical path of the first winding, configured to dissipate at least a portion of the energy that would have dissipated through the first winding and a portion of the energy that is to be dissipated through the second winding.

For example, the second winding may be sized such that all of the energy in the SMES device, and not just the portion that it contributed (e.g., 50% in the example with two windings) can discharge through the second winding. In this example, the winding would be rated for current twice the nominal current.

In other words, assume that the first winding is used to charge the SMES device a 100%. In this example, if there are only two windings (only first winding and second winding) and were no open-circuit fault in the first winding, then the first winding would dissipate 50% of the energy and the second winding would dissipate 50% of the energy. In the techniques described in this disclosure, for an example with two windings, in response to an open-circuit winding fault in an electrical path of the first winding, the second winding may dissipate at least a portion of the energy that would have dissipated through the first winding (e.g., 50% of the energy that would have dissipated through the first winding) and a portion of the energy that is to be dissipated through the second winding (e.g., the 50% of the energy that is to be dissipated through the second winding). Accordingly, in this example, all of the energy is dissipated through the second winding (e.g., 50% that would have through the first winding plus 50% that is to be dissipated through second winding for a total of 100%).

In some examples, only the first winding may be used to store energy, and in such examples the second winding provides another way to dissipate the energy. In some examples, both the first winding and the second winding may be used to store energy. In such examples, the first winding and the second winding provide other ways to dissipate the energy relative to one another.

FIG. 1 is a block diagram illustrating an example energy delivery system. Energy delivery system 10 includes power sources 12A-12N, power converters 14A-14N, supplemental power source 15 that includes superconducting magnetic energy storage (SMES) device 16 and controller 20, DC bus 17, and load 18. Energy delivery system 10 may be part of a jet engine of an airplane or part of an engine of a ship such as a jet engine or ship engine configured to function in a super cooled, superconducting state.

Power sources 12A-12N (collectively referred to as power sources 12) may provide electrical power to devices of energy delivery system 10 and more generally to the other devices on the airplane or ship via power converter 14. Power sources 12 may each deliver a respective fraction of the needed power (e.g., half if only two power sources), but may be capable of delivering all of the needed power. In this way, if one of power sources 12 is unable to provide power (e.g., due to a malfunction), the other ones of power sources 12 can still power all devices, including in the case where all but one power sources 12 malfunctions. In some examples, one of power sources 12 may be the primary power source, and the other the redundant power source. In such examples, in response to the primary power source being unable to provide power, the redundant power source provides power. In some examples, multiple power sources 12 may not be necessary, and a single power source 12 may be sufficient. Examples of power sources 12 include batteries, solar panels, gas generators, and any other type of devices or utilities that can provide DC power.

Power converters 14A-14N (collectively referred to as power converters 14) may receive AC power from respective power sources 12 and output DC power (e.g., a DC current) to DC bus 17. Load 18 and SMES device 16 receive the DC current from DC bus 17. In examples where power sources 12 output DC power, power converters 14 may not be needed.

Examples of load 18 include a motor used to drive a propeller. In general, load 18 may be any device that receives electrical current from power converter 14 and for which supplemental power source 15 provides supplemental power. Load 18 may include any device that consumes power, such as motors of vehicles or aircraft, computing devices, lighting, or any other type of device that requires a voltage or current to operate. In some examples, load 18 may include hydrogen powered automobiles, spacecraft, rockets, or other hydrogen powered device.

If one of power sources 12 were to not be able to deliver power, there is a delay before the other one of power sources 12 can deliver all the power needed by the components (e.g., by load 18). Supplemental power source 15 may be configured to deliver the needed power to load 18 during such a switch over time. Because load 18 may consume a relatively large amount of power, supplemental power source 15 may be configured to deliver such a relatively large amount of power in a relatively short amount of time.

For instance, as illustrated, supplemental power source 15 (also referred to as an uninterruptible power supply (UPS)) includes SMES device 16 and controller 20. SMES device 16 stores energy in form of a magnetic field, and that energy can be delivered as a current to power load 18. Controller 20 is configured to cause SMES device 16 to store the energy and cause SMES device 16 to deliver the current.

In some examples, in addition to or instead of acting as UPS, SMES device 16 acts as a 'peaking' unit where during short durations SMES device 16 is used to augment existing power sources (e.g., power from one or both of power sources 12). For example, power sources 12 may be formed as gas turbines that provide the main source of power, but during certain maneuvers SMES device 16 provides a short, temporary source of power rather than trying to extract power from the gas turbine (e.g., one or both of power sources 12). This would allow the gas turbine to avoid harsh transients, and may also be useful for examples of load 18 that come on/off quickly or for times when propulsion has to increase for only a short time.

Controller 20 may include any of a various types of discrete or analog circuitry (including integrated circuitry and/or programmable circuitry) for controlling components in different electrical paths through SMES device 16. SMES device 16 may be well suited for storing large amounts of energy that needs to be delivered in a relatively short amount of time. For example, SMES device 16 may be configured to store greater than or equal to approximately tens of mega-Joules (MJ), and possibly hundreds of MJ, of energy in a compact package that can be rapidly discharged, but storage of less or more energy is also contemplated.

Moreover, the components of energy delivery system 10 may be cryogenically cooled to a temperature dependent on the cryogen selected and the superconducting material to function in a superconducting state. It has been found that in a superconducting state the mass and/or size of various components such as power sources 12 and load 18 can be reduced, which may be beneficial for airplanes or ships.

SMES 16 device stores energy when SMES device 16 is configured in a superconducting state, which occurs when the wires of SMES device 16 are cooled to cryogenic temperatures. Because load 18 is already cooled to function at cryogenic temperatures, load 18 may directly interface with SMES device 16, which is also cryogenically cooled. For instance, rather than SMES device 16, if a battery backup that functions at room temperature were utilized for backup power, then additional interface components may be needed to interface load 18 to such a battery backup, which increases weight and cost.

As described above, SMES device 16 stores energy in the form of a magnetic field. For instance, SMES device 16 includes a superconducting coil wound around a former. SMES device 16 receives electrical power from power converter 14 and stores the power in the form of electromagnetic energy for purposes of delivering backup power or peaking power. The term "supplemental power" is used to refer generically to backup power or peaking power.

Power converter 14 may provide a direct current to the winding of SMES device 16. Controller 20 configures electrical paths through SMES device 16 to a charge mode to allow current to flow through SMES device 16 causing SMES device 16 to create a magnetic field which is produced as the direct current flows through the winding. After a current is induced in the superconducting coil, controller 20 configures electrical paths through SMES device 16 to a maintain mode to short the winding and allow the current to circulate within the winding (e.g., no new electrons enter the winding). Thus SMES device 16 acts as a battery, storing energy in the magnetic field until the energy is required at some point in the future. Also, due to SMES device 16 being in the superconducting state, little to no current is lost and no power is lost from heat.

Later, when the stored energy is required by load 18, controller 20 configures electrical paths through SMES device 16 to a discharge mode to interrupt the direct current circulating in the winding and cause the current to flow to load 18 (e.g., via power converter 14 or possibly directly to load 18). In this way, during the charge mode, SMES device 16 creates a magnetic field, and in the maintain mode (also referred to as a steady-state mode), SMES device 16 stores energy in form of the magnetic field, and then in the discharge mode, the magnetic field collapses and the current flows out of SMES device 16.

Figure 2A:
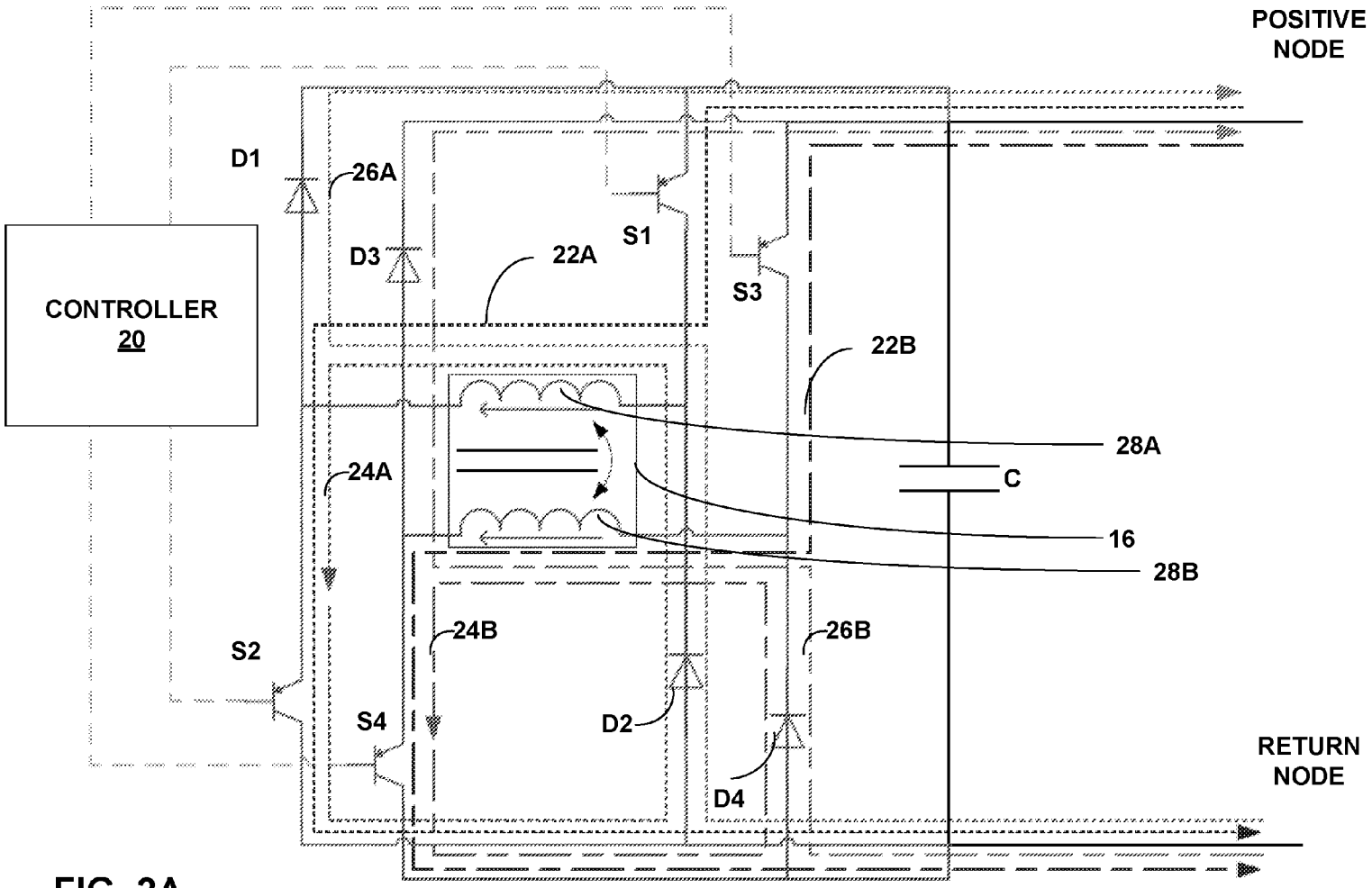
FIG. 2A is a circuit diagram illustrating an example supplemental power source that includes an superconducting magnetic energy storage (SMES) device in accordance with techniques described in this disclosure.
Figure 2B:
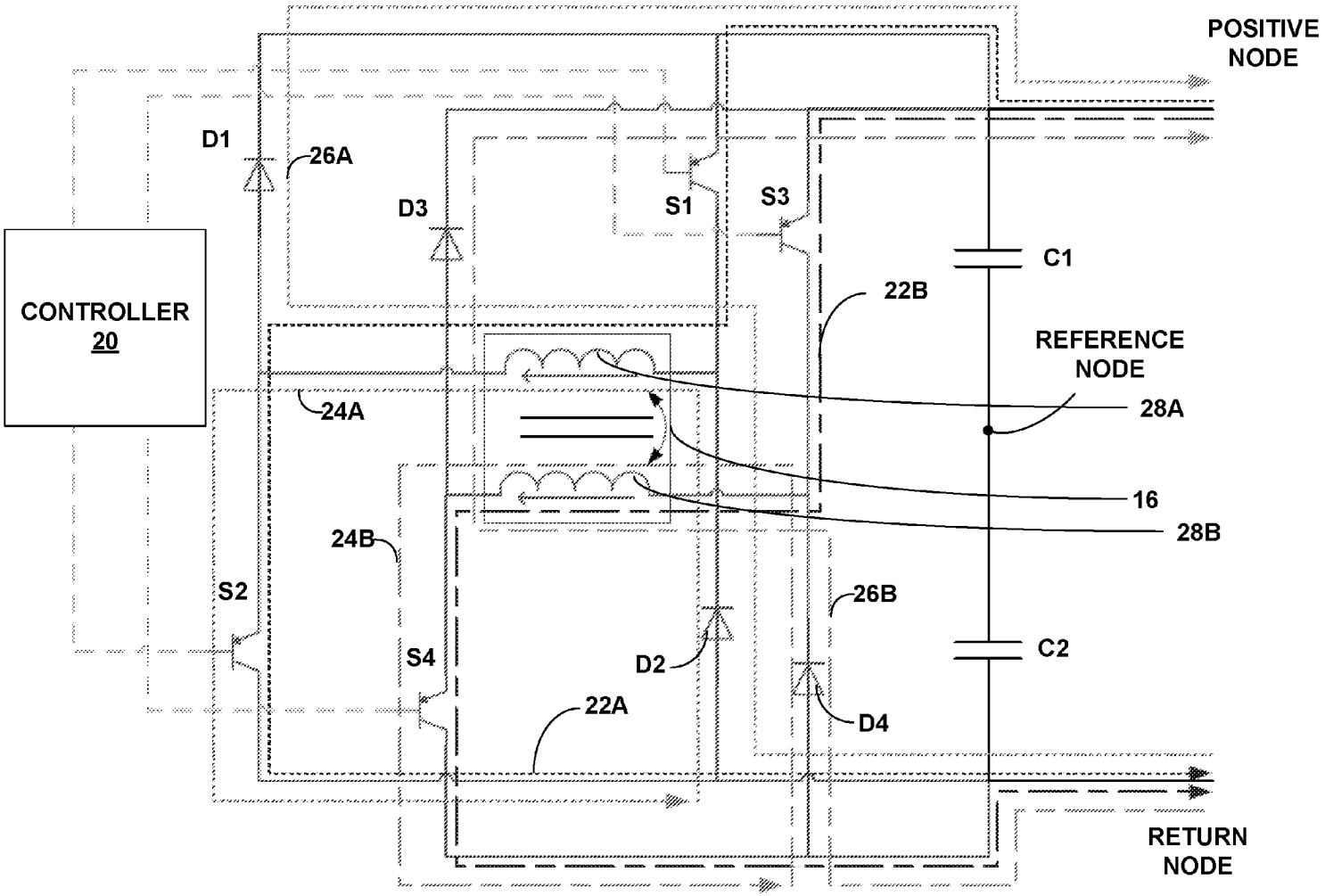
FIG. 2B is a circuit diagram illustrating another example supplemental power source that includes an SMES device in accordance with techniques described in this disclosure.

In some examples, controller 20 may control the states of the SMES device 16 using an H-bridge configuration (i.e., H-bridge 22) that includes diodes and switches, illustrated and described in more detail with respect to FIGS. 2A and 2B. For example, controller 20 may selective open and close switches in such H-bridge 22 to transition SMES device 16 from the charge mode to the maintain mode and from the maintain mode to the discharge mode.

For instance, after a current is induced in the superconducting winding, controller 20 may short H-bridge 22 so that the direct current circulates in the winding of SMES device 16. When there is a need for the energy stored in SMES device 16, controller 20 may open H-bridge 22 such that there is no longer a short in the circuit. Current from SMES device 16 may then flow to load 18. In this way, SMES device 16 is configured to deliver the stored energy to load 18 (e.g., a motor) in response to one of power sources 12A-12N turning off or in response to a need for peaking power (e.g., controller 20 may control SMES device 16 through the charge, maintain, and discharge modes for peaking power for short durations). In other words, SMES device 16 is configured to provide supplemental power as needed.

While SMES device 16 is well suited for supplemental power delivery, SMES device 16 may be susceptible to open-circuit winding faults. In an open-circuit winding fault, in any of the charge, maintain, or discharge modes, there is an open circuit condition in a respective electrical path of the charge, maintain, or discharge mode. In the open-circuit winding fault, there is an interruption in the electrical path of the current flowing through SMES device 16. The interruption in the electrical path of the current causes a very high kickback voltage, which may cause switches in the electrical path to reverse conduct, fault close, or simply fail to be capable of conduction until SMES device 16 is fully discharged. The reverse current conduction may cause a negative voltage to develop on load 18 and cause sparking or arcing, all of which may be undesirable. For example, as described above SMES device 16 stores a relatively high amount of energy, and an open-circuit winding fault causes SMES 16 to dissipate that high amount of energy in an extremely fast and uncontrolled matter.

This disclosure describes example techniques for configuring SMES device 16 to be fault tolerant (e.g., fault tolerant to an open-circuit winding fault). For example, rather than SMES device 16 including a single wire or wire bundle winding, SMES device 16 includes a plurality of windings (i.e., two or more windings). In this sense, SMES device 16 may be considered as a coupled SMES device. For instance, the plurality of windings may be interwoven with another (e.g., interspersed and/or layered with one another), rather than being wound at distinct, separate regions of the core. The plurality of windings includes parallel inductor windings that share a common former (e.g., toroidal former). In some examples, the former may be a core such as a magnetic core, but the techniques are not limited to magnetic cores. Vacuum cores are another possible example of a former.

By interweaving the plurality of windings, each of the windings provides an alternative path for the energy stored in the magnetic field. For example, under normal operation, if there are N windings on SMES device 16, then one or more of the N windings may together store energy in the magnetic field (e.g., common magnetic field). During the discharge mode, the energy stored in the magnetic field dissipates via respective N windings. However, if there is an open-circuit winding fault in one of the windings, then the energy that would have dissipated through the winding with the open-circuit winding fault can dissipate through the remaining N−1 windings (i.e., each one of the N−1 "healthy" windings dissipates a portion of the energy). As an example, the N−1 windings may each dissipate (N/(N−1)) times the amount of stored energy, representing the energy stored in each of the N−1 windings and the winding having the fault. Accordingly, while not all windings may be needed to generate the magnetic field and store the energy (but possible to use all windings to generate and store the magnetic field), the windings may form as backup ways for the energy to dissipate in the event any one of the windings experiences an open-circuit fault condition in its electrical path.

In this way, the N−1 windings provide a current path during an open-circuit winding fault in one of the windings. Accordingly, there is a reduction in a kickback voltage in the faulty winding or a reverse conduction of current through switches, and therefore, no extremely fast dissipation of the relative high amount of energy stored in SMES device 16. For instance, one possibility may be to rely on a kickback diode to help dissipate the energy and prevent damaging negative voltages. However, relying only on a kickback diode to dissipate the energy may be insufficient for the power, voltage, and/or current levels at which SMES device 16 operates. With additional windings as described in this disclosure, the energy can dissipate through these additional windings, and while kickback diodes may be utilized, they may not be necessary in all cases.

As an example, SMES 16 may include a former, a first winding, and a second winding. There may be a plurality of additional windings as well, but for ease of description this example is described with respect to two windings. In this example, the first winding includes a first wire conductor wound around the former, the first winding is configured to be in a superconducting state to store energy in a magnetic field. Also, the second winding includes a second wire conductor wound around the same former and interwoven with the first winding. The second winding is configured to be in the superconducting state. In response to an open-circuit winding fault in an electrical path of the first winding, the second winding may be configured to dissipate at least a portion of the energy that would have dissipated through the first winding and a portion of the energy that is to be dissipated through the second winding.

For instance, in this example with two windings, the second winding may dissipate all of the energy in the magnetic field in response to an open-circuit winding fault in an electrical path of the first winding (e.g., 50% of the energy that the second winding is to dissipate plus the 50% of the energy that would have dissipated through the first winding in the absence of there being an open-circuit winding fault in an electrical path through the first winding). Similarly, the first winding may dissipate at least a portion (e.g., all in this example) of the energy in the magnetic field in response to an open-circuit winding fault in an electrical path in the second winding. In examples where there are a plurality of additional windings, each of the additional windings, in response to an open-circuit winding fault in an electrical path of a winding, is configured to dissipate at least a portion of energy stored in the magnetic field that would have dissipated through that winding. Such a coupled example of SMES device 16 may be smaller, cheaper, and simpler for filtering with increased efficiency.

FIG. 2A is a circuit diagram illustrating an example supplemental power source that includes an superconducting magnetic energy storage (SMES) device in accordance with techniques described in this disclosure. For example, FIG. 2A illustrates an example of supplemental power source 15 in a two-wire system referenced to ground (e.g., return node in FIG. 2A). A capacitor C is coupled to the positive node and the negative node, as illustrated.

Controller 20 configures SMES device 16 into a charge mode to create a magnetic field via current flowing through respective ones of the plurality of windings on SMES device 16, followed by a maintain mode so that each of the plurality of windings store energy in the magnetic field (e.g., there is one magnetic field that each of the windings contribute to with the current flowing through the respective windings), and followed by a discharge mode to dissipate the stored energy. In some examples, when one of the windings is in the charge mode, then the other windings should be in the maintain mode. For instance, controller 20 may ensure that during the charge mode for one of the windings, the other windings are in maintain mode. Once all windings have charged, then controller 20 may set all windings into the maintain mode, so that all of the windings individually contribute to the total magnetic field. Then, controller 20 may set each of the windings into discharge mode, and each of the windings discharge their respective portions of the magnetic field.

FIG. 2A illustrates the electrical paths for the charge mode, maintain mode, and discharge mode. In FIG. 2A, the direction of the flow of current through the windings of SMES device 16 is the same. For ease of illustration, SMES device 16 is configured in a two wire system with a floating reference. However, the techniques described in this disclosure are not so limited, and may be extended to examples for multiple wiring configurations including a two wire system referenced to ground or a three-wire, dual voltage system (as illustrated in FIG. 2B).

Figure 3:
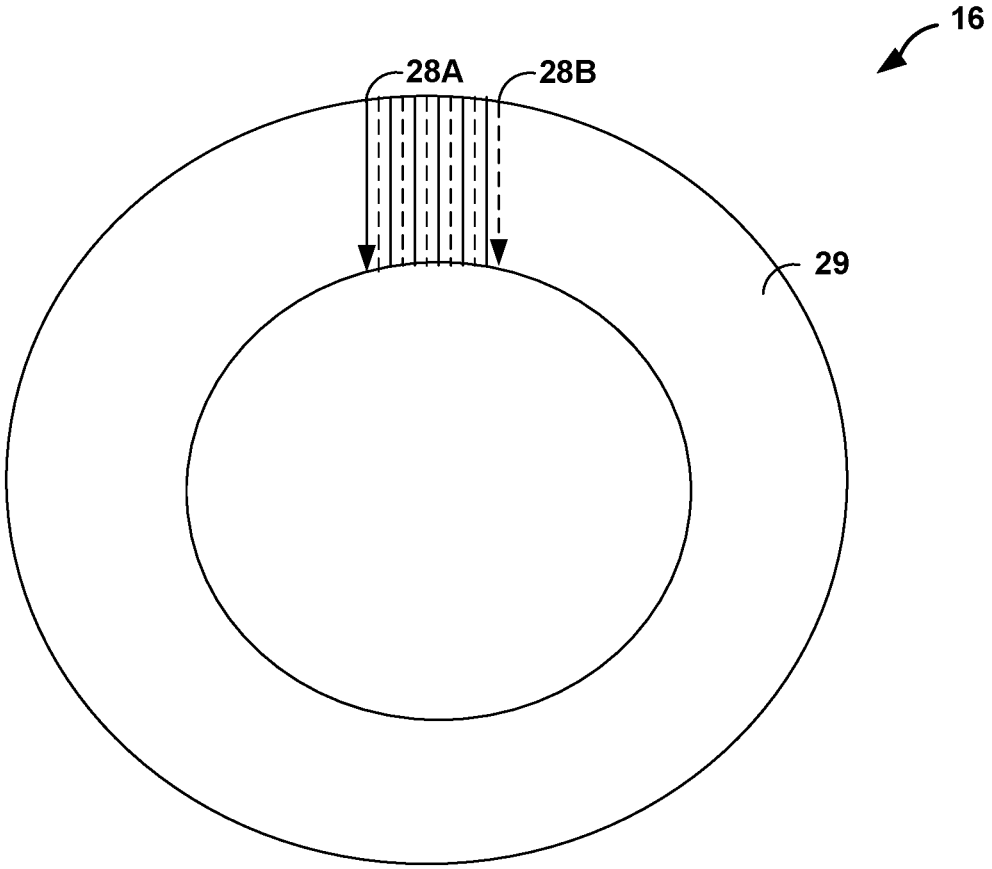
FIG. 3 illustrates an example of a first winding and a second winding of an SMES device interwoven with another.

In FIG. 2A, SMES device 16 includes a first winding 28A, and a second winding 28B wound around a former (e.g., core 29 illustrated in FIG. 3). It should be noted that first winding 28A and second winding 28B are illustrated in their respective locations in FIG. 2A for ease, and that first winding 28A and second winding 28B are interwoven with another (e.g., the wire that forms first winding 28A is interspersed or layered with the wire that forms second winding 28B), as described and illustrated with respect to FIG. 3.

FIG. 3 illustrates an example of first winding 28A and second winding 28B of SMES device 16 interwoven with another. For example, in FIG. 3, the wire that forms first winding 28A (i.e., the non-dashed line) is interspersed with the wire that forms 28B (i.e., the dashed line), but in other examples, the wires may be layered. First winding 28A and second winding 28B are wound around the same toroidal former 29, as illustrated in FIG. 3. Also, the winding direction of first winding 28A and second winding 28B is the same (as illustrated by the arrows) and the direction of the current through first winding 28A and second winding 28B is the same, the combination of which produces flux linkage between the windings. Although only one region of SMES device 16 is illustrated as having turns of first winding 28A and second winding 28B, it should be understood that in some examples, all of toroidal former 29 is wound with wires of first winding 28A and wires of second winding 28B in an interwoven way.

As illustrated in FIG. 2A, first winding 28A is coupled to switches S1 and S2 and diodes D1 and D2, and second winding 28B is coupled to switches S3 and S4 and diodes D3 and D4. Switches S1, S2, S3, and S4 may be insulated-gate bipolar transistors (IGBTs), but other examples are contemplated. Diodes D1, D2, D3, and D4 and switches S1, S2, S3, and S4 may be cryogenically cooled (e.g., down to 100 K), but may not be necessarily in a superconducting state. Accordingly, there may be some loss in the current flowing through the diodes and switches. If the diodes and switches function in a superconducting state, then the loss in current may be further minimized. Switches S1 and S2 and diodes D1 and D2 together form part of H-bridge 22 around first winding 28A, and switches S3 and S4 and diodes D3 and D4 together form part of H-bridge 22 around second winding 28B. Controller 20 modulates (e.g., opens and closes) switches S1, S2, S3, and S4 of H-bridge 22 to configure SMES device 16 in the charge, maintain, or discharge mode.

In FIG. 2A, during the charging mode, current flows through electrical path 22A to charge first winding 28A, and current flows through electrical path 22B to charge second winding 28B. In some examples, during the charging of first winding 28A, second winding 28B may be in maintain mode, and vice-versa. However, in some examples, it may be possible to keep both first winding 28A and second winding 28B in charging mode when respective currents are both flowing through respective ones of first winding 28A and second winding 28B. In this case, the magnetic field may be generated more quickly as current is flowing through both first winding 28A and second winding 28B simultaneously, as compared to if only one was being charged.

For charging, controller 20 modulates (e.g., open and closes) switches S1 and S2 (e.g., IGBTs) so that current flows through electrical path 22A as illustrated. The current flows from the positive node through switch S1, through first winding 28A, through switch S2, and to the return node. A surge arrester may be optionally included. Similarly, for second winding 28B, controller 20 modulates (e.g., open and closes) switches S3 and S4 (e.g., IGBTs) so that current flows through electrical path 22B as illustrated. The current flows from the positive node through switch S3, through second winding 28B, through switch S4, and to the return node. A surge arrester may be optionally included. In this way, controller 20 controls the amount of current injected into first winding 28A and second winding 28B and thus determines how fast SMES device 16 is charged.

After the rated current is induced in first winding 28A and second winding 28B, controller 20 shorts first winding 28A and second winding 28B to allow the current and magnetic field to circulate. Because first winding 28A and second winding 28B are in the superconducting state (e.g., by the cryogenic cooling), the resistance of the wire of first winding 28A and the wire of second winding 28B approaches zero, which impacts the dissipative energy from SMES device 16. The wire of first winding 28A and second winding 28B maintains minimal resistance if the current is maintained under its critical current losses. Some losses may occur through switches S1, S2, S3, and S4, and over time SMES device 16 may require additional current to "top off" the stored energy through the charge cycle.

In FIG. 2A, electrical path 24A illustrates the electrical path through first winding 28A during the maintain mode, and electrical path 24B illustrates the electrical path through second winding 28B during the maintain mode. For example, during the maintain mode, current flows through first winding 28A in the same direction as during the charging mode, through switch S2 which is closed by controller 20, through diode D2, and back through first winding 28A making a loop and circulating the current through first winding 28A. There may be some energy loss in switch S2 and possibly D2, but the loss may be minimal. Similarly, for second winding 28B, during the maintain mode, current flows through second winding 28B in the same direction as during the charging mode, through switch S4 which is closed by controller 20, through diode D4, and back through second winding 28B making a loop and circulating current through second winding 28B. As above, there may be some energy loss in switch S4 and possibly diode D4, but the loss may be minimal.

In some examples, if the voltage across first winding 28A and second winding 28B drops below the voltage at positive node and return node, then SMES device 16 may need to be charged. SMES device 16 may be discharged if it has a higher voltage than the system. For instance, if the voltage across first winding 28A and second winding 28B was higher than the voltage at the positive node and the return node, controller 20 may cause SMES device 16 to discharge.

For example, controller 20 may configure first winding 28A and second winding 28B to the discharge mode, in which controller 20 opens switches S2 and S4 for the respective currents flowing through first winding 28A and second winding 28B. For example, electrical path 26A illustrates the electrical path through first winding 28A during the discharge mode. As illustrated, during the discharge mode, current flows from the return node through diode D2, through first winding 28A in the same direction as during the charge and maintain modes, through diode D1, and to the positive node. Similarly, electrical path 26B illustrates the electrical path through second winding 28B during the discharge mode. As illustrated, during the discharge mode, current flows from the return node through diode D4, through second winding 28B in the same direction as during the charge and maintain modes, through diode D3, and to the positive node.

In the techniques described in this disclosure, during normal operation, first winding 28A and second winding 28B store energy in magnetic field via the charge and maintain modes where currents flow as illustrated with electrical path 22A and electrical path 24A, respectively, for first winding 28A and as illustrated with electrical path 22B and electrical path 24B, respectively, for second winding 28B. Then, during discharge mode, first winding 28A dissipates its portion of the energy via electrical path 26A, and second winding 28A dissipates its portion of the energy via electrical path 26B.

However, in the event of an open-circuit winding fault in first winding 28A, the stored energy has an alternative path through which it can flow (i.e., electrical path 26B). In this case, the energy dissipated via electrical path 26B includes the portion of the energy that second winding 28B is to dissipate and the portion of the energy that would have been dissipated by first winding 28A if there was no open-circuit winding fault. Similarly, in the event of an open-circuit winding fault in second winding 28B, the stored energy has an alternative path through which it can flow (i.e., electrical path 26A). In this case, the energy dissipated via electrical path 26A includes the energy that first winding 28A is to dissipate and the energy that would have been dissipated by first winding 28A if there was no open-circuit winding fault. For example, the direction of the windings of first winding 28A and second winding 28B and the direction of the flow of current may be the same, meaning that there is flux linkages in first winding 28A and second winding 28B allowing for energy to dissipate through the other winding (e.g., no fault winding).

An open-circuit winding fault may occur if there is an open-circuit in any of electrical paths 22A, 22B, 24A, 24B, 26A, or 26B during respective charge, maintain, or discharge modes. For instance, an open-circuit condition in the maintain mode with respect to electrical path 24A and 24B is described. However, a similar open-circuit condition may occur during a charge mode or a discharge mode in any one of electrical paths 22A, 22B, 26A, or 26B.

For electrical path 24A, if switch S2 opens or diode D2 opens in the maintain mode, then first winding 28A may experience an open-circuit winding fault in electrical path 24A. If switch S4 opens or diode D4 opens in the maintain mode, then second winding 28B may experience an open-circuit winding fault in electrical path 24B.

Accordingly, in FIG. 2A, a first electrical path (e.g., electrical path 22A) through first winding 28A includes a first switch (e.g., switch S1), and first winding 28A is configured to create a portion of a magnetic field in response to controller 20 closing switch S1. A second electrical path (e.g., electrical path 24A) through first winding 28A includes a second switch (e.g., switch S2), and first winding 28A is configured to store energy in the magnetic field in response to controller 20 closing switch S2. A third electrical path (e.g., electrical path 22B) through second winding 28B includes a third switch (e.g., switch S3), and second winding 28B is configured to create a portion of the magnetic field in response to controller 20 closing switch S3. A fourth electrical path (e.g., electrical path 24B) through second winding 28B includes a fourth switch (e.g., switch S4), and second winding 28B is configured to store energy in the magnetic field in response to controller 30 closing switch S4.

In accordance with one or more examples described in this disclosure, a fifth electrical path (e.g., electrical path 26B) through second winding 28B is configured to dissipate a portion of the energy stored in the magnetic field, and configured to dissipate at least a portion of the energy that would have dissipated through first winding 28A in response to an open-circuit winding fault in electrical path 22A, 24A, or 26A. Similarly, a sixth electrical path (e.g., electrical path 26A) through first winding 28A is configured to dissipate a portion the energy stored in the magnetic field, and configured to dissipate at least a portion of the energy that would have dissipated through second winding 28B in response to an open-circuit winding fault in electrical path 22B, 24B, or 26B.

For instance, in the example illustrated in FIG. 2A, there are two windings around the former (i.e., first winding 28A and second winding 28B). In such examples, in response to an open-circuit winding fault in one of the windings, all of the energy stored is dissipated via the other winding, rather than each dissipating 50% of the energy. In other words, in the winding that is not having the fault, that winding dissipates its portion of the energy (e.g., 50%) and the portion of the energy that would have been dissipated by the other winding if there was no fault (e.g., the remaining 50%).

However, in some examples there may be more than two windings (e.g., a plurality of additional windings each including respective wires wound around the same former of SMES device 16 and interwoven with first winding 28A and second winding 28B). In such examples, in response to an open-circuit winding fault on first winding 28A, the energy that would have dissipated through first winding 28A instead dissipates through second winding 28B and the additional windings (e.g., each of these windings dissipating a portion of the energy that would have dissipated through first winding 28A). Similarly, in such examples, in response to an open-circuit winding fault on second winding 28B, the energy that would have dissipated through second winding 28B instead dissipates through first winding 28A and the additional windings (e.g., each of these windings dissipating a portion of the energy that would have dissipated through second winding 28B).

The energy calculation of coupled SMES device 16 (e.g., SMES device 16 having a plurality of windings that are interwoven with one another) with two windings is:

$$W_{M2} = \frac{1}{2}[i_1 \quad i_2]\begin{bmatrix} L_{11} & L_{12} \\ L_{12} & L_{22} \end{bmatrix}\begin{bmatrix} i_1 \\ i_2 \end{bmatrix} = \frac{1}{2}(L_{11}i_1^2 + 2L_{12}i_1i_2 + L_{22}i_2^2)$$

The above equation illustrates that if the total energy remains the same, in the event that one current goes to zero due to a fault or a failure in a winding, the current in the other winding will increase. This increase in current in the "healthy" winding (e.g., one without the fault) can be transmitted to load 18, transferred to some other energy storage device, or dissipated depending on the architecture and concept of operations of energy delivery system 10. Transferring current through healthy winding may prevent a discharge of energy in a very short time, which would happen if there was only one winding and an open-circuit winding fault occurred on this winding. In other words, the healthy winding is configured to dissipate energy from the winding with the fault at a rate slower than a rate at which the energy would have dissipated only through the winding with the fault.

Also, FIG. 2A and the above equation relate to a two winding system. The following equation is for an N winding system (e.g., where there are a plurality of additional windings in addition to first winding 28A and second winding 28B):

$$W_{Mn} = \frac{1}{2}[i_i \ \ i_2 \ \dots \ i_n]\begin{bmatrix} L_{11} & L_{12} & \dots & L_{1n} \\ L_{21} & L_{22} & \dots & L_{2n} \\ \vdots & \vdots & \ddots & \vdots \\ L_{n1} & L_{n2} & \dots & L_{nn} \end{bmatrix}\begin{bmatrix} i_1 \\ i_2 \\ \vdots \\ i_n \end{bmatrix}$$

It should be understood that although the example illustrated in FIG. 2A and described above describes a case where first winding 28A and second winding 28B together contribute to a magnetic field, the techniques described in this disclosure are not so limited. In some examples, only a current flowing through first winding 28A may be used to generate the magnetic field and store the energy. In such examples, if there is no open-circuit fault condition, first winding 28A and second winding 28B may dissipate respective portions of the energy, but if there is an open-circuit fault condition in first winding 28A, second winding 28B may dissipate the portion of the energy that second winding 28B is to dissipate and dissipate the portion of the energy that first winding 28A was to dissipate. In some examples, only a current flowing through second winding 28A may be used to generate the magnetic field and store the energy. In such examples, if there is no open-circuit fault condition, first winding 28A and second winding 28B may dissipate respective portions of the energy, but if there is an open-circuit fault condition in second winding 28B, first winding 28A may dissipate the portion of the energy that first winding 28A is to dissipate and dissipate the portion of the energy that second winding 28B was to dissipate. In some examples, both first winding 28A and second winding 28B may be used to generate the magnetic field and store the energy.

FIG. 2B is a circuit diagram illustrating another example supplemental power source that includes an SMES device in accordance with techniques described in this disclosure. For example, FIG. 2B illustrates an example of a three-wire system as compared to FIG. 2A that illustrates a dual-wire system.

The components having the same reference numerals in FIGS. 2A and 2B are the same, and are not described further. As illustrated in FIG. 2B, rather than a single capacitor C (as in FIG. 2A, there are two capacitors, C1 and C2. Capacitor C1 couples to the positive node, capacitor C2 couples to the negative node, and capacitors C1 and C2 couple to one another. At the point where capacitors C1 and C2 couple is a reference node. In some examples, the reference node may be connected to ground, and in some examples, the reference node may be connected to some other reference voltage. The example illustrated in FIG. 2B, the positive node, negative node, and the reference node may each be coupled to a respective wire, thereby forming a three-wire system, and possibly a three-wire dual rail system.

Figure 4:
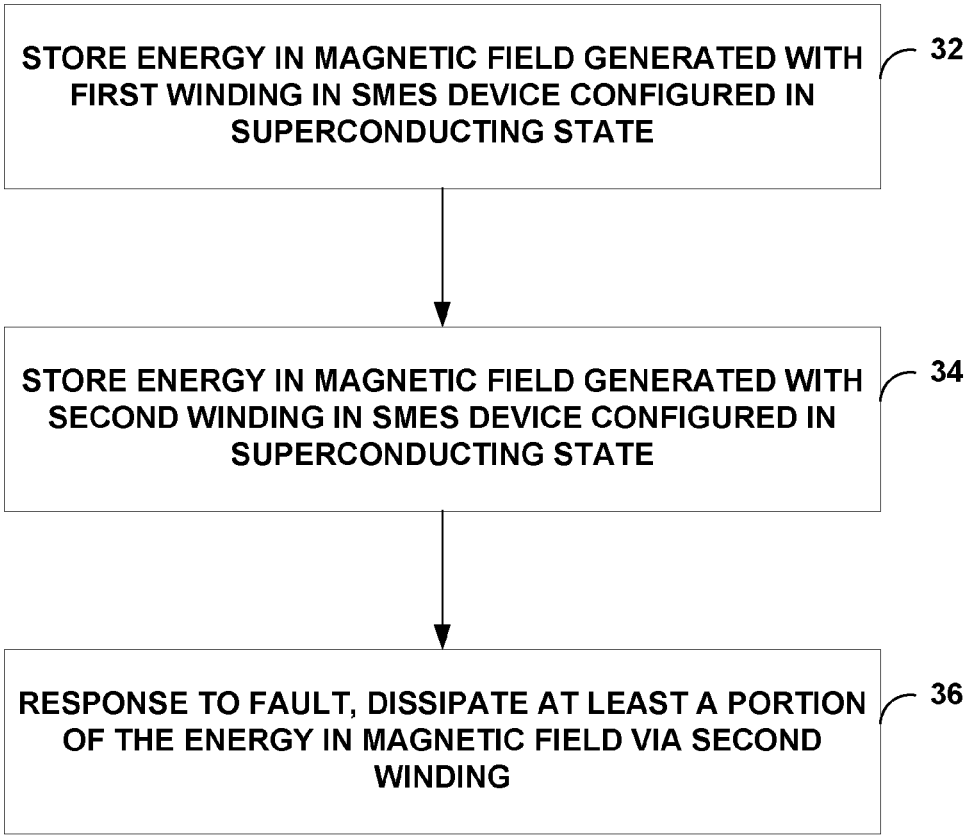
FIG. 4 is a flow diagram illustrating example method of energy delivery in accordance with techniques described in this disclosure.

FIG. 4 is a flow diagram illustrating example technique of energy delivery. As illustrated in FIG. 4, SMES device 16 configured in a superconducting state stores energy in a magnetic field generated from a first current flowing through a first winding (e.g., first winding 28A) of a first wire conductor wound around former 29 of SMES device 16 (32). For instance, controller 20 may close switch S1 and cause a current to flow via a first electrical path (e.g., electrical path 22A) through first winding 28A to create a first portion of the magnetic field. Then, controller 20 may close switch S2 and cause the current to flow via a second electrical path (e.g., electrical path 24A) and circulate through first winding 28 to store the energy in the magnetic field.

SMES device 16 configured in the superconducting state stores energy in the magnetic field generated from a second current flowing through a second winding (e.g., second winding 28B) of a second wire conductor wound around the same former 29 of SMES device 16, where the second wire is interwoven (e.g., interspersed or layered) with the first wire (34). For instance, controller 20 may close switch S3 and cause a current to flow via a third electrical path (e.g., electrical path 22B) through second winding 28B to create a second portion of the magnetic field. Then, controller 20 may close switch S4 and cause the current to flow via a fourth electrical path (e.g., electrical path 24B) and circulate through second winding 28 to store the energy in the magnetic field.

In response to an open-circuit winding fault in an electrical path of the first winding (e.g., open-circuit winding fault in electrical path 22A, 24A, or 26A), second winding 28B dissipates dissipate at least a portion of the energy that would have dissipated through the first winding and a portion of the energy that is to be dissipated through the second winding (36). For example, the energy stored in the magnetic field would dissipate through a fifth electrical path (e.g., electrical path 26B) in response an open-circuit winding fault in an electrical path through first winding 28A (e.g., electrical path 22A, 24A, or 26A in a respective charge, maintain, or discharge mode).

If SMES device 16 includes no other windings in addition to first winding 28A and second winding 28B, then second winding 28B would dissipate all of the energy in the magnetic field. However, in some examples, there may be a plurality of additional windings each including respective wires wound around the former 29 and interwoven with first winding 28A and second winding 28B. In such examples, each of the additional windings, in response to an open-circuit winding fault in an electrical path of a winding, is configured to dissipate at least a portion of energy stored in the magnetic field that would have dissipated through that winding. In some examples, second winding 28B may dissipate the portion of energy that would have dissipated through first winding 28A in response to the open-circuit winding fault in the electrical path of first winding 28A (e.g., electrical path 22A, 24A, or 26A through first winding 28A in respective charge, maintain, and discharge modes) at a rate slower than a rate at which all of the energy in the magnetic field would have dissipated if there was no second winding 28B.

Although the above examples describe first winding 28A experiencing an open-circuit winding fault, in some examples, second winding 28B may experience an open-circuit winding fault. In such cases, in response to an open-circuit winding fault in an electrical path of second winding 28B, first winding 28A is configured to dissipate at least a portion of the energy that would have dissipated through second winding 28B and a portion of the energy that is to be dissipated through first winding 28A. For example, first winding 28A may dissipate the energy that would have dissipated from second winding 28B via a sixth electrical path (e.g., electrical path 26A).

Various examples of this disclosure have been described. These and other examples are within the scope of the following claims.

What is claimed is:

1. A superconducting magnetic energy storage (SMES) device comprising:

a toroidal former;

a first winding comprising a first wire conductor wound around the former, the first winding configured to be in a superconducting state to store energy in a magnetic field; and a second winding comprising a second wire conductor wound around the same former and interwoven with the first winding, the second winding configured to be in the superconducting state and, in response to an open-circuit winding fault in an electrical path of the first winding, configured to dissipate at least a portion of the energy that would have dissipated through the first winding and a portion of the energy that is to be dissipated through the second winding.

2. The SMES device of claim 1, wherein the first winding, in response to an open-circuit winding fault in an electrical path of the second winding, is configured to dissipate at least a portion of the energy that would have dissipated through the second winding and a portion of the energy that is to be dissipated through the first winding.

3. The SMES device of claim 1, further comprising:

a plurality of additional windings each comprising respective wires wound around the same former and interwoven with the first and second windings, wherein each of the additional windings, in response to an open-circuit winding fault in an electrical path of a winding, is configured to dissipate at least a portion of energy stored in the magnetic field that would have dissipated through that winding.

4. The SMES device of claim 1, wherein the SMES device comprises no other windings in addition to the first and second windings, and wherein the second winding is configured to dissipate all of the energy in the magnetic field in response to the open-circuit fault in the electrical path in the first winding.

5. The SMES device of claim 1, wherein the second winding is configured to dissipate the portion of energy that would have dissipated through the first winding in response to the open-circuit winding fault in the electrical path of the first winding at a rate slower than a rate at which all of the energy in the magnetic field would have dissipated if there was no second winding.

6. The SMES device of claim 1, wherein current flowing through the first winding and the second winding and a winding direction of the first winding and the second winding is the same.

7. The SMES device of claim 1, wherein the second wire interwoven with the first winding comprises the second wire interspersed with the first wire.

8. The SMES device of claim 1, wherein the second wire interwoven with the first winding comprises the second wire layered with the first wire.

9. The SMES device of claim 1, wherein the first winding further comprises first and second switches coupled to the first wire conductor, wherein the first winding is configured to create a first portion of the magnetic field in response to the first switch being closed and store the energy in the magnetic field in response to the second switch being closed, wherein the second winding further comprises third and fourth switches coupled to the second wire conductor, and wherein the second winding is configured to create a second portion of the magnetic field in response to the third switch being closed and store the energy in the magnetic field in response to the fourth switch being closed.

10. An energy delivery system comprising:

a superconducting magnetic energy storage (SMES) device, the SMES device comprising:

a toroidal former;

a first winding comprising a first wire conductor wound around the former, the first winding configured to be in a superconducting state to store energy in a magnetic field; and a second winding comprising a second wire conductor wound around the same former and interwoven with the first winding, the second winding configured to be in the superconducting state, and, in response to an open-circuit winding fault in an electrical path of the first winding, configured to dissipate at least a portion of the energy that would have dissipated through the first winding and a portion of the energy that is to be dissipated through the second winding;

a first electrical path through the first winding, the first electrical path comprising a first switch, wherein the first winding is configured to create a first portion of the magnetic field in response to the first switch being closed;

a second electrical path through the first winding, the second electrical path comprising a second switch, wherein the first winding is configured to store the energy in the magnetic field in response to the second switch being closed;

a third electrical path through the second winding, the third electrical path comprising a third switch, wherein the second winding is configured to create a second portion of the magnetic field in response to the third switch being closed;

a fourth electrical path through the second winding, the fourth electrical path comprising a fourth switch, wherein the second winding is configured to store the energy in the magnetic field in response to the fourth switch being closed; and a fifth electrical path through the second winding, wherein, in response to the open-circuit winding fault in the electrical path of the first winding, the fifth electrical path is configured to dissipate at least the portion of the energy that would have dissipated through the first winding and the portion of the energy that is to be dissipated through the second winding.

11. The energy delivery system of claim 10, further comprising:

a load cooled to a cryogenic temperature and coupled to the SMES device; and a power source cooled to the cryogenic temperature and coupled the SMES device, wherein the SMES device is configured to deliver the energy stored in the magnetic field to the load for supplemental power.

12. The energy delivery system of claim 11, wherein the first winding is configured to receive a first current from the power source used to store as energy in the magnetic field, and the second winding is configured to receive a second current from the power source used to store as energy in the magnetic field.

13. The energy delivery system of claim 10, wherein the SMES device further comprises:

a plurality of additional windings each comprising respective wires wound around the same former and interwoven with the first and second windings, wherein each of the additional windings, in response to an open-circuit winding fault in an electrical path of a winding, is configured to dissipate at least a portion of energy stored in the magnetic field that would have dissipated through that winding.

14. The energy delivery system of claim 10, further comprising:

a controller configured to open and close the first, second, third, and fourth switches to configure the first winding and the second winding in a charge mode, maintain mode, and discharge mode.

15. The energy delivery system of claim 10, further comprising:

a sixth electrical path through the first winding, wherein, in response to an open-circuit winding fault in an electrical path of the second winding, the sixth electrical path is configured to dissipate at least a portion of the energy that would have dissipated through the second winding and a portion of the energy that is to be dissipated through the first winding.

16. The energy delivery system of claim 10, wherein the energy delivery system is part of an airplane or a ship.

17. The energy delivery system of claim 10, wherein current flowing through the first winding and the second winding and a winding direction of the first winding and the second winding is the same.

18. The energy delivery system of claim 10, wherein the second wire interwoven with the first winding comprises the second wire interspersed with the first wire.

19. A method of energy delivery, the method comprising:

storing energy in a magnetic field in a superconducting magnetic energy storage (SMES) device configured in a superconducting state, the magnetic field being partially generated from a first current flowing through a first winding of a first wire conductor wound around a toroidal former of the SMES device, the first winding configured to be in a superconducting state to store energy in the magnetic field;

storing energy in the magnetic field in the SMES device configured in the superconducting state, the magnetic field being partially generated from a second current flowing through a second winding of a second wire conductor wound around the same former of the SMES device and interwoven with the first wire conductor of the first winding, the second winding configured to be in the superconducting state; and in response to an open-circuit winding fault in an electrical path of the first winding, dissipating, by the second winding, at least a portion of the energy that would have dissipated through the first winding and a portion of the energy that is to be dissipated through the second winding.

20. The method of claim 19, further comprising:

in response to an open-circuit winding fault in an electrical path of the second winding, dissipating at least a portion of the energy that would have dissipated through the second winding and a portion of the energy that is to be dissipated through the first winding.

* * * * *